US007775944B1

(12) United States Patent
Shultz

(10) Patent No.: US 7,775,944 B1
(45) Date of Patent: Aug. 17, 2010

(54) KINEMATIC ROTATING-TILTING MECHANISM

(76) Inventor: Larry D. Shultz, 23050 Compass Dr., Canyon Lake, CA (US) 92587

( * ) Notice: Subject to any disclaimer, the term of this patent is extended or adjusted under 35 U.S.C. 154(b) by 685 days.

(21) Appl. No.: 11/810,684

(22) Filed: Jun. 7, 2007

(51) Int. Cl.
*A63B 21/00* (2006.01)
*A63B 21/008* (2006.01)
*A63G 1/00* (2006.01)
*A61H 1/02* (2006.01)

(52) U.S. Cl. ..... 482/92; 482/110; 601/87; 472/29

(58) Field of Classification Search ..... 482/51, 482/92, 110, 121, 148; 472/135, 14, 18, 472/29, 97; 601/24, 32, 27–28, 87
See application file for complete search history.

(56) References Cited

U.S. PATENT DOCUMENTS 1,241,171 A 9/1917 Vitullo
1,338,616 A 4/1920 Ewing
1,747,543 A 2/1930 Gregory
2,104,764 A 1/1938 Sanders et al.
2,707,465 A * 5/1955 Nemeth ..... 601/87
3,439,914 A * 4/1969 Willard ..... 472/18
3,481,599 A * 12/1969 Johnson ..... 472/18
3,581,739 A 6/1971 William et al.
3,863,982 A 2/1975 Sandham
4,057,289 A 11/1977 Jones
4,061,137 A * 12/1977 Sandt ..... 601/86
4,538,807 A * 9/1985 Rice ..... 482/147
4,890,886 A 1/1990 Opsvik
5,063,911 A * 11/1991 Teranishi ..... 601/46
5,091,733 A 2/1992 Labruyere
5,186,424 A 2/1993 Shultz et al.
5,228,155 A 7/1993 Shultz et al.
5,881,985 A 3/1999 Hoenig
5,888,182 A * 3/1999 Shih ..... 482/147
5,976,097 A * 11/1999 Jensen ..... 601/24
6,945,602 B2 9/2005 Fookes et al.

* cited by examiner

*Primary Examiner*—Steve R Crow
(74) *Attorney, Agent, or Firm*—Albert O. Cota

(57) ABSTRACT

A kinematic rotating-tilting mechanism (10) that consists of six major elements: a housing (12), a housing flange assembly (42), a platform flange assembly (70), a platform base (90), a resilient section (110) and an angled shaft (120). The housing (12) includes an upper end (18) having a cover (20) to which is attached the housing flange assembly (42), and attached to the lower surface (98) of the platform (90) is the platform flange assembly (70). The shaft (120) has a lower vertical section (122) that is rotatably attached to the housing flange assembly (42), and an upper angled section (126) that is rotatably attached to the platform flange assembly (70). The platform base (90) has an upper surface (96) to which is attached a resilient section (110). A person who is located on the resilient section (110) can produce torque by shifting their body weight. The torque causes the resilient section (110) to produce a combination rotating and tilting motion that promotes neuro-muscular stimulation, is relaxing, and aids in relieving stress.

20 Claims, 6 Drawing Sheets

KINEMATIC ROTATING-TILTING MECHANISM

TECHNICAL FIELD

The invention generally pertains to the field of exercising equipment, and more particularly to a kinematic rotating-tilting mechanism that allows a person located on a platform attached to the mechanism to perform exercising routines that produce torque, which causes the platform to simultaneously rotate and tilt.

BACKGROUND ART

The prior art is replete with various designs of equipment that allow a person to perform various exercising routines or to help a person relax and relieve stress. Some of the prior art equipment utilizes an articulated platform that is designed to mechanically or electrically produce a rotational or tilting motion or to produce a combination of both a rotational and a tilting motion.

The rotational and/or tilting motions of the prior art equipment are typically achieved by utilizing a complex arrangement of components that are activated by means of mechanical devices or by an electric motor. These components, because of their complexity, are subject to malfunctions, require preventive maintenance and must be properly used to assure safe and continual operation.

The instant invention eliminates malfunctions or at least reduces incidents of malfunctions by having a simple mechanical design that utilizes a minimum amount of components to produce a combination rotating and tilting motion.

A search of the prior art did not disclose any patents that read directly on the claims of the instant invention, however the following U.S. patents are considered related:

| U.S. Pat. No. | INVENTOR | ISSUED |
|---|---|---|
| 5,228,155 | Shultz et al | 20 Jul. 1993 |
| 5,186,424 | Shultz et al | 16 Feb. 1993 |
| 3,581,739 | William et al | 1 Jun. 1971 |

The U.S. Pat. No. 5,228,155 discloses a multi-tilting apparatus that periodically tilts a platform supporting a person's body. The platform periodically tilts side-to-side and head-to-foot with the side tilt following the head tilt and preceding the foot tilt. The apparatus comprises a base, the platform, an elongated teeter-totter board pivotally mounted upon the base and a drive shaft upon which is mounted a tilted plate. Low frictional rollers support the platform on the tilted plate, with the platform also being pivotally supported on a first pivot axis on the teeter-totter board. The platform does not turn as the drive shaft turns, but rather tilts multi-directionally as the tilted plate turns on the drive shaft, thereby contacting the rollers on the platform.

The U.S. Pat. No. 5,186,424 discloses a base for a human support apparatus, such as a bed or a chair, which produces a rocking chair type of motion. The base also includes a motor, which when driven, simultaneously moves the bed or chair in a circular motion within a horizontal plane. The inventor of the U.S. Pat. No. 5,186,424 and the U.S. Pat. No. 5,228,155 is also the inventor of the instant application.

The U.S. Pat. No. 3,581,739 discloses a machine that is equipped with a rotating support platform having two degrees of freedom of motion in the plane of the platform which can also be tilted at an angle to the horizontal. A person placed on the platform is subject to downward as well as lateral gravitational forces as the platform rotates and/or translates. Muscular resistance to this force produces an effective and relatively effortless exercise and therapeutic effect. The angle of tilt and the speed of rotation can be varied to suit the individual.

For background purposes and as indicative of the art to which the invention is related reference may be made to the remaining patents located in the search.

| U.S. Pat. No. | INVENTOR | ISSUED |
|---|---|---|
| 6,945,602 | Fookes et al | 20 Sep. 2005 |
| 5,881,985 | Hoenig | l6 Mar. 1999 |
| 5,091,733 | Labruyere | 25 Feb. 1992 |
| 4,890,886 | Opsvik | 2 Jan. 1990 |
| 4,061,137 | Sandt | 6 Dec. 1977 |
| 4,057,289 | Jones | 8 Nov. 1977 |
| 3,863,982 | Sandham | 4 Feb. 1975 |
| 2,707,465 | Nemeth | 3 May 1955 |
| 2,104,764 | Sanders et al | 11 Jan. 1938 |
| 1,747,543 | Gregory | 18 Feb. 1930 |
| 1,338,616 | Ewing | 27 Apr. 1920 |
| 1,241,171 | Vitullo | 25 Sep. 1917 |

DISCLOSURE OF THE INVENTION

The kinematic rotating-tilting mechanism (KRTM) is designed to allow an individual located on a platform base, which is controlled by the mechanism, to cause the platform base to simultaneously rotate and tilt. The magnitude of the rotating and tilting is controlled by torque that is applied when the individual shifts their body weight, which causes a muscular resistance that translates into the applied torque. The rotating and tilting movements allow an individual to exercise, relieve stress, and relax. In its basic design configuration the KRTM consists of a) A housing having a lower end and an upper end, wherein the upper end has a cover having a housing shaft bore.

b) A platform base having a shaft bore.

c) A shaft having a lower vertical section having means for being rotatably attached to the housing shaft bore located on the housing, and an upper angled section having means for being rotatably attached to the shaft bore located on the platform base.

d) Means for vertically securing the shaft.

When a right or left lateral force is applied to the platform base by a person located on the platform base, torque is produced that causes the lower vertical section of the shaft to rotate through a 360-degree rotation or any increment thereof. The shaft rotation causes the platform base to also rotate in either a right or a left horizontal circular plane. Simultaneously, the rotation of the upper angled section of the shaft causes the platform base to rotate and alternate its angular position. That is, the front end of the platform base moves from a lower position to an upward position, while the rear end of the platform base moves from an upward position to a lower position. Thus, the platform base simultaneously rotates and tilts.

The means for rotatably attaching the lower vertical section of the shaft to the housing shaft bore located on the housing comprises a housing flange assembly that is attached to the upper surface of the housing cover by an attachment means. The housing flange assembly includes a substantially-centered, upper bearing cavity and a lower bearing cavity. Each bearing cavity has therethrough a cavity shaft bore that is in alignment with the housing shaft bore located on the housing. An upper bearing is inserted into the upper bearing cavity and attached thereto by a bearing attachment means. And a lower bearing is inserted into the lower bearing cavity and is attached thereto by a bearing attachment means.

The means for rotatably attaching the upper angled section of the shaft to the shaft bore located on the platform base comprises a platform flange assembly that is attached to the lower surface of the platform base by an attachment means. The platform flange assembly includes a substantially-centered, upper bearing cavity and a lower bearing cavity. Each bearing cavity has therethrough a cavity shaft bore that is in alignment with the shaft bore located on the platform base. An upper bearing is inserted into the upper bearing cavity and is attached thereto by a bearing attachment means. And a lower bearing is inserted into the lower bearing cavity and attached thereto by a bearing attachment means.

The means for maintaining the shaft in a vertical position comprises at least one collar that is located between the housing flange assembly and the platform flange assembly.

To add to the utility of the KRTM, a resilient section is attached to the upper surface of the platform base. The resilient section is dimensioned to comfortably allow a person who is located on the upper surface of the resilient section to produce the required torque to operate the mechanism.

In view of the above disclosure, the primary object of the invention is to provide a KRTM that allows a person who is located on the resilient section to cause the resilient section to simultaneously produce a series of rotational and tilting motions that are relaxing, stress-relieving, and therapeutic.

In addition to the primary object of the invention it is also an object of the invention to produce a KRTM that:

- allows a person to bodily control the rotational speed and tilting action of the mechanism,
- utilizes body-induced gravitational forces to operate the mechanism,
- allows the resilient section attached to the platform base to be easily removed for cleaning and maintenance,
- provides an exercise routine that can be selectively organized and modified to suit the need of an individual user,
- can be used to display various works of art, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
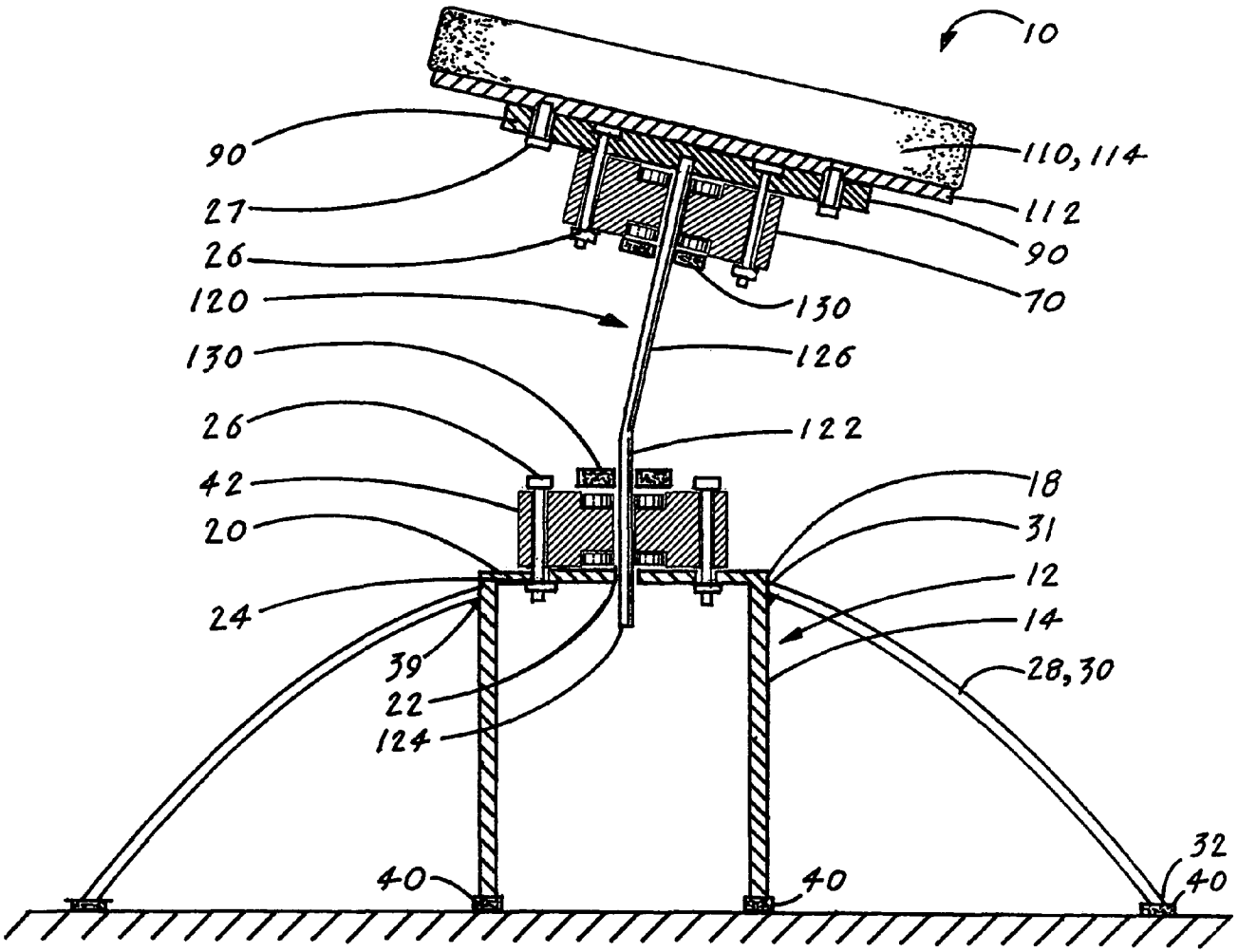
FIG. 1 is a side elevational, cross-sectional view of a kinematic rotating-tilting mechanism showing the relative locations of a housing having attached thereto, a set of curved legs, a housing flange assembly, a platform flange assembly, a shaft and a platform base having attached a resilient section.

The best mode for carrying out the invention is presented in terms of a preferred embodiment for a kinematic rotating-tilting mechanism (hereinafter "KRTM 10"). The preferred embodiment of the KRTM 10, as shown in FIGS. 1-12, is comprised of the following six major elements: a housing 12, a housing flange assembly 42, a platform flange assembly 70, a platform base 90, a resilient section 110 and a shaft 120.

Figure 2:
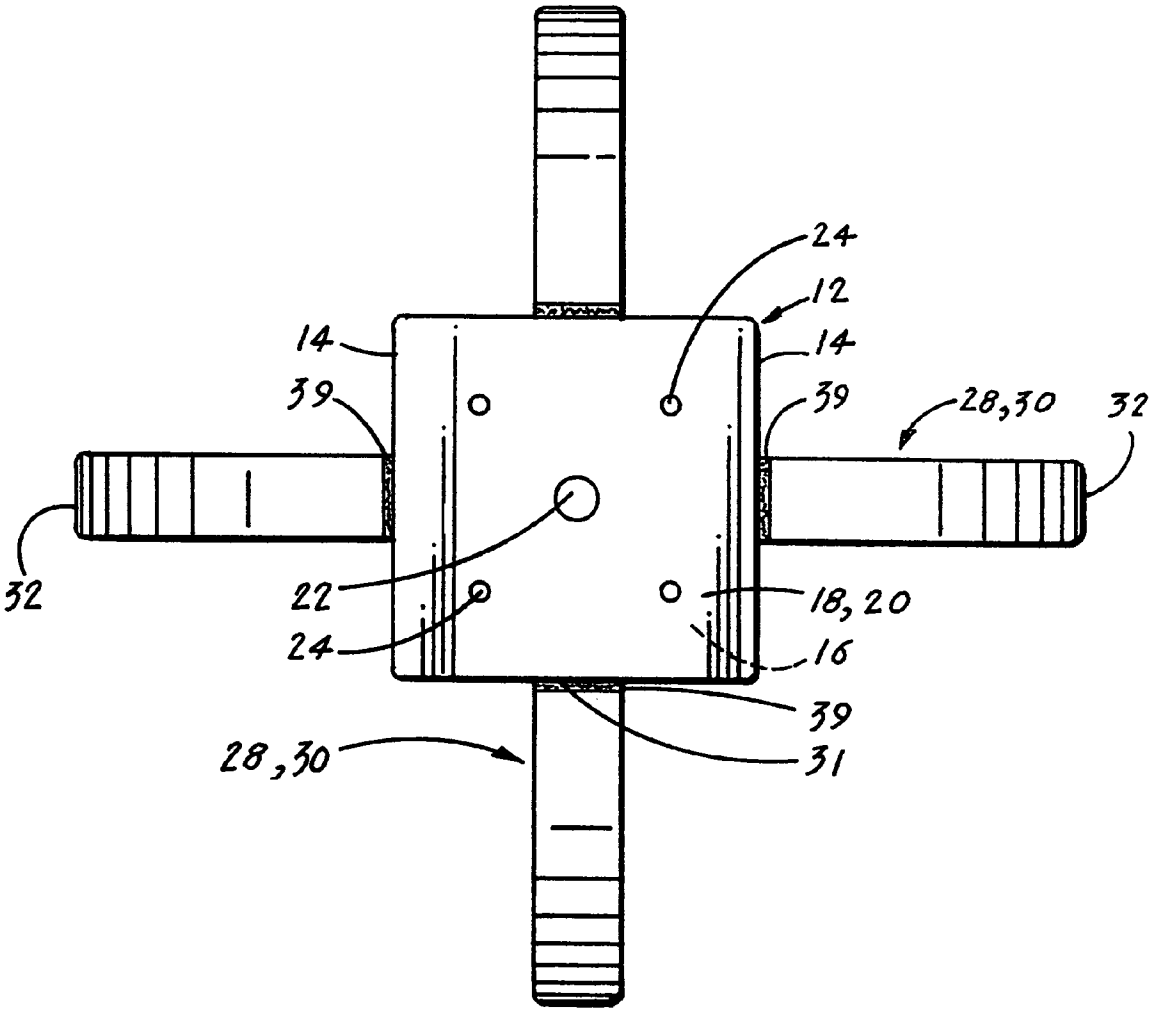
FIG. 2 is a top plan view of the housing that has attached a set of four equidistant curved legs.
Figure 3:
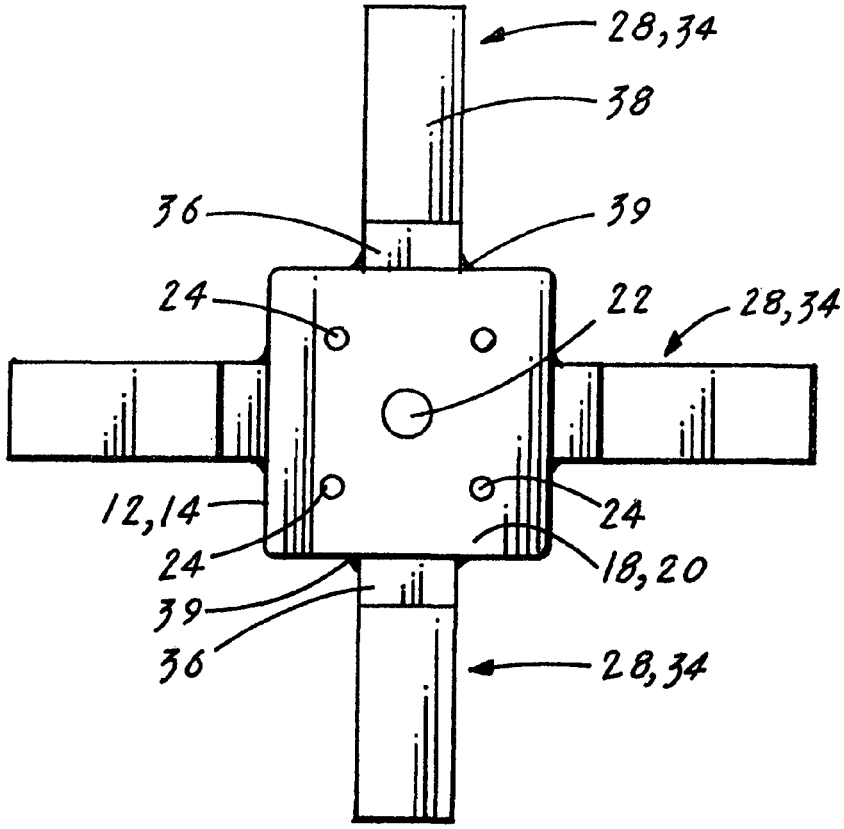
FIG. 3 is a top plan view of the housing having attached four equidistant L-shaped legs.

The housing 12, as shown in FIGS. 1-4, has enclosed sides 14, a lower end 16 and an upper end 18. The lower end 16, as best shown in FIG. 1, is open to facilitate the manufacturing process and also provides a means for attaching the housing assembly flange 42 and for adjusting the vertical level of the shaft 120. The upper end 18 of the housing 12 has an integrally attached cover 20, as shown in FIGS. 1 and 2. The cover 20 has a housing shaft bore 22 and a plurality of flange attachment bores 24, as shown in FIGS. 2 and 3.

Figure 4:
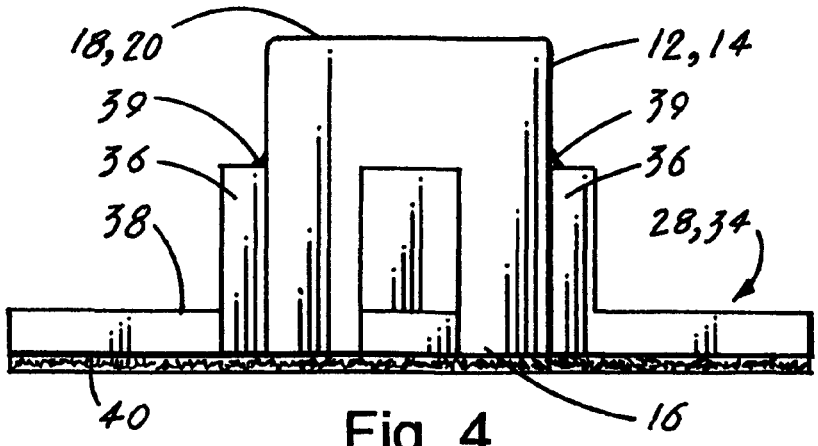
FIG. 4 is a side elevational view of the housing shown in FIG. 3.

As shown in FIGS. 1-4, the housing 12 is further comprised of a set of four housing legs 28. Each leg 28 can consist of a curved leg 30, as shown in FIGS. 1 and 2, or an L-shaped leg 34, as shown in FIGS. 3 and 4.

The curved legs 30 each have an upper end 31 and a lower end 32. The upper ends 31 are equidistantly spaced around the housing and are attached adjacent to the upper end 18 of the housing 12 by a leg attachment means 39, such as welding. The lower ends 32 of the curved legs 30 are dimensioned so that they are on the same plane as the lower end 16 of the housing, as shown in FIG. 1. The lower ends 32 of the legs 30, as well as the lower end 16 of the housing 12, can include a resilient cap section 40 that is frictionally inserted.

The L-shaped legs 34, as shown in FIGS. 3 and 4, each have a vertical section 36 and a horizontal section 38. The horizontal section 38 is on the same plane as the lower end 16 of the housing 12, as shown in FIG. 4. The vertical sections are each equidistantly spaced and attached to the respective side of the housing 12 by a leg attachment means 39, such as welding. A resilient section 40 can also be attached to the lower surface of the vertical section 36, as also shown in FIG. 4.

Figure 5:
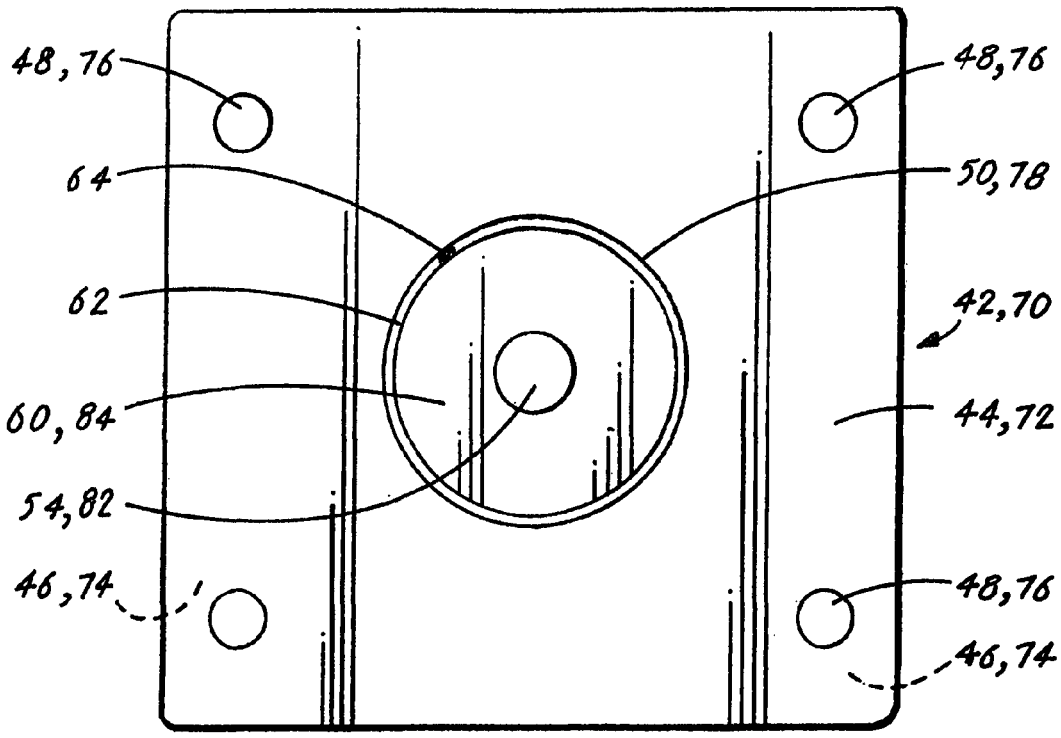
FIG. 5 is a top plan view that illustrates to both the housing flange assembly and the platform flange assembly.
Figure 6:
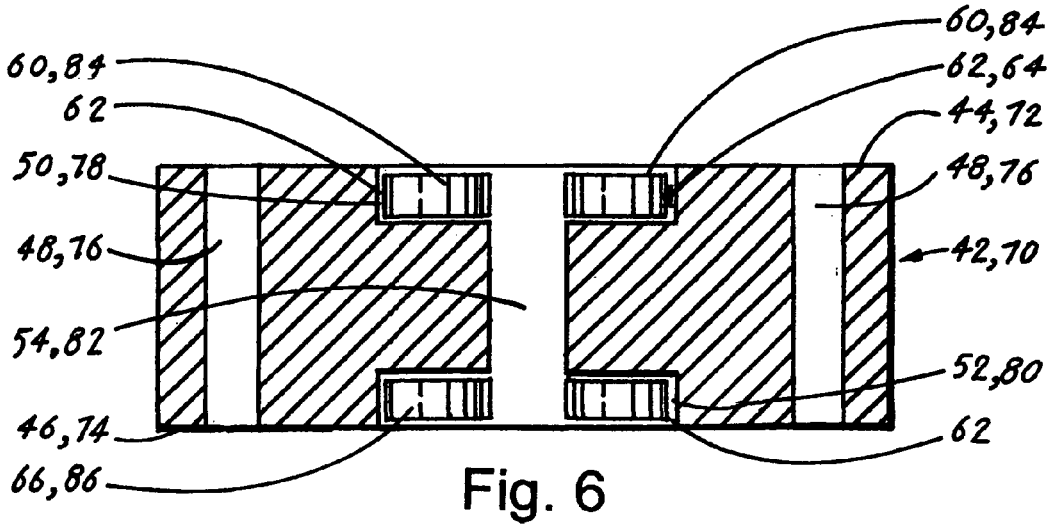
FIG. 6 is a side elevational, cross-sectional view of the housing and the platform flange assemblies shown in FIG. 5.

The housing flange assembly 42 is shown attached to the housing 12 in FIG. 1, and by itself in FIGS. 5 and 6. The assembly 42 is comprised of an upper surface 44, a lower surface 46 and a plurality of housing attachment bores 48 that are in alignment with the plurality of flange attachment bores 24 that are located on the cover 20 of the housing 12. The flange assembly 42 is attached to the housing 12 by a like plurality of a bolt and nut combinations 26, as shown in FIG. 1. The housing flange assembly 42, as shown best in FIGS. 5 and 6, is also comprised of a substantially-centered upper bearing cavity 50, a lower bearing cavity 52, an upper bearing 60 and a lower bearing 66.

The upper bearing cavity 50 and the lower bearing cavity 52 each have therethrough a cavity shaft bore 54 that is in alignment with the housing shaft bore 22 which is located on the cover 20 of the housing 12. The upper bearing 60 and the lower bearing 66 are respectively inserted into the upper bearing cavity 50 and the lower bearing cavity 52. The bearings 60,66 are attached into their respective cavities 50,52 by a friction fit that can be augmented by an adhesive 64 which is applied between the bearings and their respective cavity interfacing surface.

The platform flange assembly 70 is dimensioned and designed identically to the housing flange assembly 42. However, because of the assemblies placement and different function it is described with different reference numerals.

The platform flange assembly 70 is shown attached to the platform base 90 in FIG. 1, and by itself in FIGS. 5 and 6. The assembly 70 is comprised of an upper surface 72, a lower surface 74 and a plurality of platform attachment bores 76 that are in alignment with a like plurality of flange attachment bores 104 that are located on the platform base 90. The platform flange assembly 70 is attached to the platform base 90 by a like plurality of a bolt and nut combinations 26, as shown in FIG. 1.

The platform flange assembly 70, as shown best in FIGS. 5 and 6, is also comprised of a substantially-centered, upper bearing cavity 78, a lower bearing cavity 80, an upper bearing 84 and a lower bearing 86.

Figure 7:
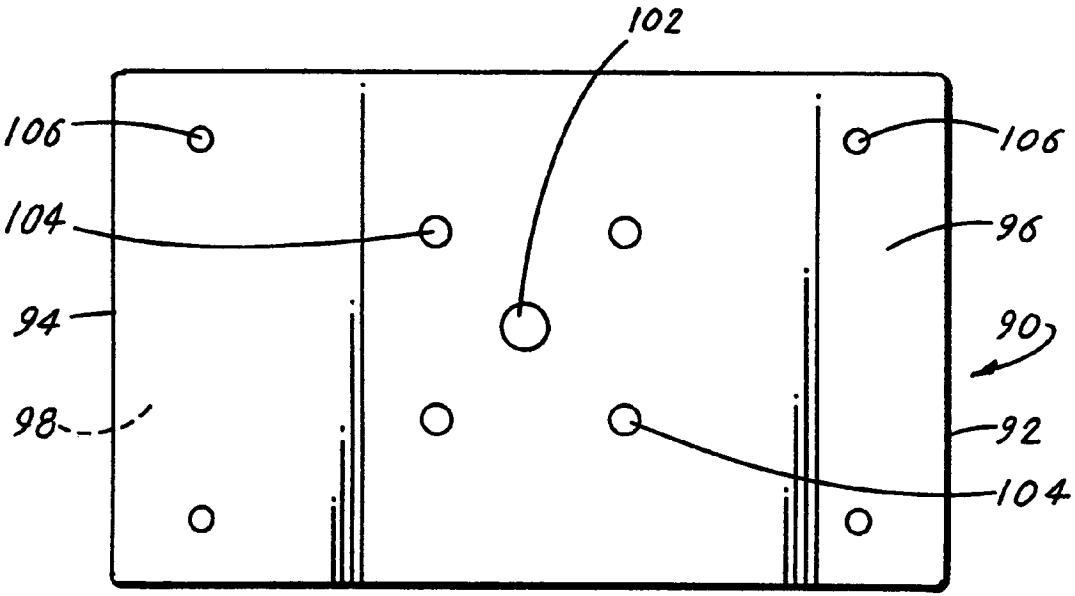
FIG. 7 is a top plan view of the platform base.
Figure 8:
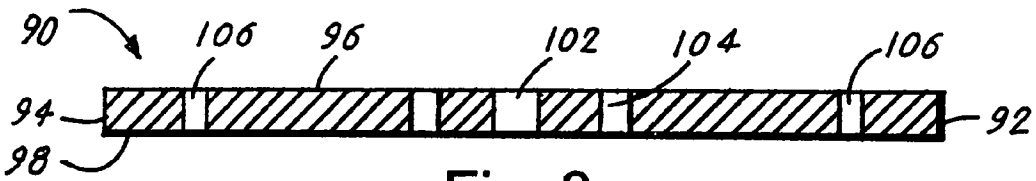
FIG. 8 is a side elevational, cross-sectional view of the platform base shown in FIG. 7.

The upper bearing cavity 78 and the lower bearing cavity 80 each have therethrough a cavity shaft bore 82 that is in alignment with the shaft bore 102 which is located on the platform base 90, as best shown in FIGS. 7 and 8. The upper bearing 84 and the lower bearing 86 are respectively inserted into the upper bearing cavity 78 and the lower bearing cavity 80, and are attached therein by a friction fit 62 that can be augmented by an adhesive 64 which is applied between the bearings and their respective cavity interfacing surface.

The upper and lower bearings located on the housing flange assembly 42 and the platform flange assembly 70 are preferably comprised of ball bearings 68. However, other type of bearings such as nonmetallic sleeve and flanged bearings, needle-roller bearings and bronze sleeve bearings can also be utilized.

The platform base 90, as shown attached in FIG. 1, and by itself in FIGS. 7 and 8, is comprised of a front end 92, a rear end 94, an upper surface 96 and a lower surface 98. Located at or near the center of gravity of the platform base 90 is a shaft bore 102 that is in alignment with the cavity shaft bore 82, which is located on the platform flange assembly 70. As best shown in FIG. 7, the platform base 90 also includes a plurality of flange attachment bores 104 that are in alignment with the plurality of platform attachment bores 76, which are located on the platform flange assembly 70. The platform base 90 is attached to the upper surface 72 of the platform flange assembly 70 by a like plurality of bolt and nut combinations 26. Near the front end 92 and the rear end 94 of the platform base 90 are located a plurality of resilient section attachment bores 106, as shown in FIGS. 7 and 8.

Figure 10:
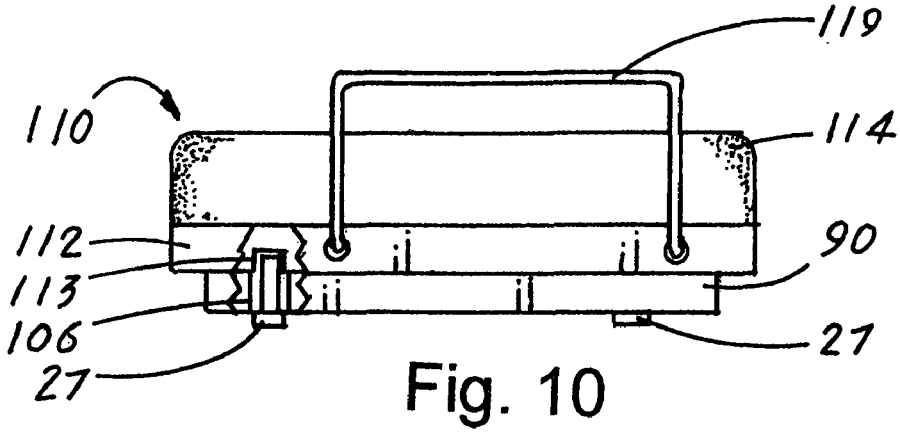
FIG. 10 is a side elevational view of the platform base having attached a flat resilient section, a cut-away view showing a means for attaching the resilient section to the platform base and an optional pair of hand gripping bars.

The resilient sections 110, as shown in FIGS. 1, 10, 11 and 12, are designed to be attached to a base section 112 by conventional upholstering means. As shown in FIG. 10, the base section 112 includes a plurality of threaded inserts 113 that are in alignment with the plurality of resilient section attachment bores 106 located on the platform base 90. To attach the resilient sections 110 to the platform base 90, a threaded bolt 27 is inserted into the bore 106 and threaded into the threaded insert 113.

Figure 11:
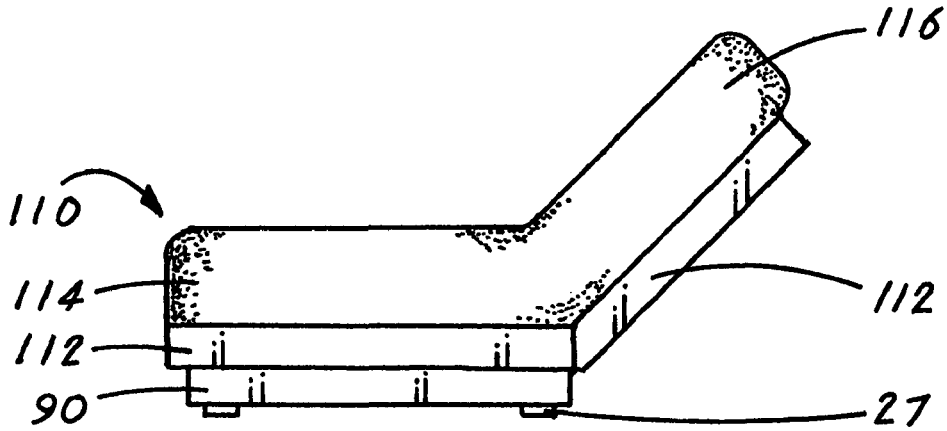
FIG. 11 is a side elevational view of the platform base having a flat resilient section having attached to one side an upward reclined section.
Figure 12:
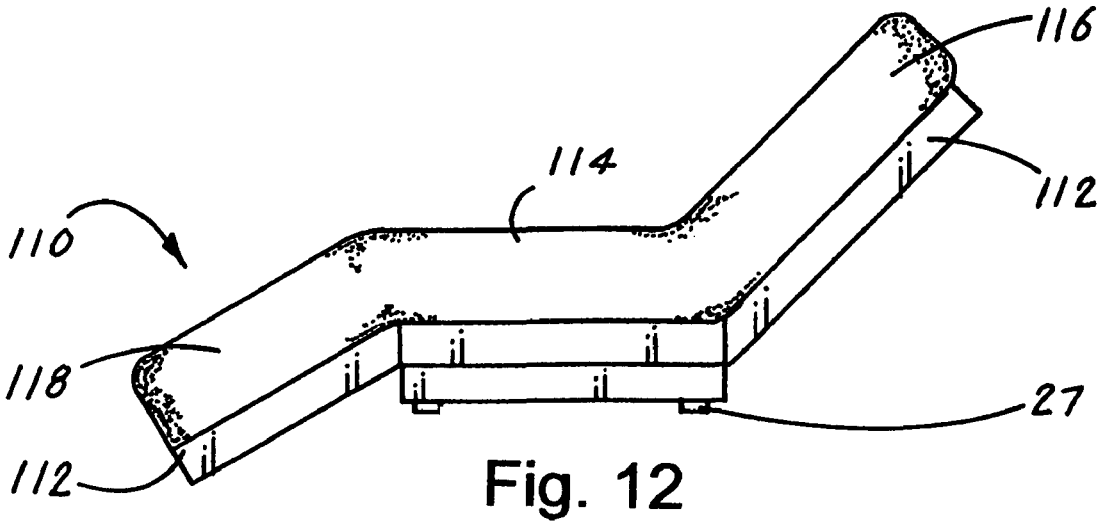
FIG. 12 is a side elevational view of the platform base having attached on one end of a flat section an upward reclined section, and on an opposite end a downward reclining section.

The resilient sections 110 can be designed with a single flat section 114, as shown in FIG. 10; a resilient section 110 having on one end of the flat section 114 an upward reclined section 116, as shown in FIG. 11; or as shown in FIG. 12, a flat section 114 having an upward reclined section 116 on one end and a downward reclined section 118 on an opposite end. The base section 112 can also be designed to have attached a hand grasping bar 119, as shown in FIG. 10. The bar 119, which can consist of a fixed bar or an articulated bar, functions as a safety bar and, when grasped by a person located on the resilient sections 110, the torque applied by the body, as described below, is facilitated.

Figure 9:
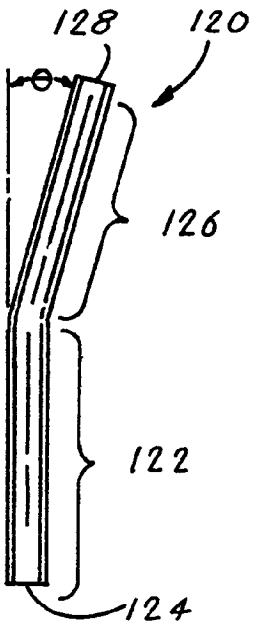
FIG. 9 is a side elevational view of the shaft.

The final element comprising the KRTM 10 is the shaft 120, as shown attached to the KRTM 10 in FIG. 1, and by itself in FIG. 9. The shaft 120 includes a lower vertical section 122 having a lower terminus 124 and an integral, upper angled section 126. The upper angled section 126 has an upper terminus 128 and an angle θ that can range between 2 to 10 degrees, as measured from the lower vertical section 122.

The lower vertical section 122 is inserted sequentially through the upper bearing 60 and the lower bearing 66 of the housing flange assembly 42, with the lower terminus 124 located within the confines of the housing 12. The upper angled section 126 is inserted sequentially into the lower bearing 86 and the upper bearing 84 of the platform flange assembly 70, with the upper terminus 128 projecting outward from the upper bearing 84 and into the shaft bore 102 located on the platform base 90. To secure the shaft 120, a shaft collar 130 is inserted and attached to the shaft 120. The collar 130 preferably consists of a two-piece clamp-on collar that is located adjacent the lower surface 74 of the platform flange assembly 70. To further secure the shaft 120, a second collar 130 can be inserted into the shaft 120 adjacent the upper surface 44 of the housing flange assembly 42, as shown in FIG. 1.

To operate the KRTM 10, a right or left lateral force is applied to the platform base 90 when a person located on the resilient section 110 moves their body in a right or left direction. The body movement causes torque to be produced, which causes the lower vertical section 122 of the shaft 120 to laterally rotate through a 360-degree rotation or any increment thereof. The rotation causes the platform base to rotate in either a right or left horizontal circular plane. Simultaneously, the upper angled section 126 of the shaft 120 causes the platform base 90 to rotate and alternate its angular position. That is, the front end of the platform base 90 moves from a lower position to an upward position, while the rear end of said platform base 90 moves from an upward position to a lower position. Thus, the platform base 90 simultaneously causes the resilient section 110 to rotate and tilt.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A kinematic rotating-tilting mechanism comprising:

a) a housing having a lower end and an upper end, wherein the upper end has a cover having a housing shaft bore, b) a platform base having a shaft bore, c) a shaft having a lower vertical section having bearing means for being rotatably attached to the housing shaft bore located on said housing, and an upper angled section having means for being rotatably attached to the shaft bore located on said platform base, and d) bearing means for securing said shaft in a vertical position, wherein when a right or left lateral force is applied to said platform base by a person located on the platform base, torque is produced that causes the lower vertical section of said shaft to rotate through a 360-degrees rotation or any increment thereof, thereby causing said platform base to rotate in either a right or left horizontal circular plane, simultaneously the upper angled section of said shaft causes said platform base to rotate and alternate its angular position, that is, the front end of said platform base moves from a lower position to an upward position, while the rear end of said platform base moves form an upward position to a lower position, thus said platform base simultaneously rotates and tilts; said bearing means permit the platform to move relative to the shaft, and said shaft's lower end to move relative to the housing.

2. The mechanism as specified in claim 1 further comprising'a set of four housing legs, wherein each said leg has an upper end that is equidistantly spaced and attached adjacent to the upper end of said housing by a leg attachment means, and a lower end that is located on the same plane as the lower end of said housing.

3. The mechanism as specified in claim 2 wherein said leg attachment means comprises welding.

4. The mechanism as specified in claim 1 wherein said means for rotatably attaching the lower vertical section of said shaft to the housing shaft bore located on said housing comprises a housing flange assembly that is attached to the upper surface of said housing cover by an attachment means, said housing flange assembly having:

a) a substantially-centered, upper bearing cavity and a lower bearing cavity, wherein each said bearing cavity having therethrough a cavity shaft bore that is in alignment with the housing shaft bore located on said housing, b) an upper bearing that is inserted into the upper bearing cavity and attached thereto by a bearing attachment means, and c) a lower bearing that is inserted into the lower bearing cavity and attached thereto by a bearing attachment means.

5. The mechanism as specified in claim 4 wherein said means for rotatably attaching the upper angled section of said shaft to the shaft bore located on said platform base comprises a platform flange assembly that is attached to the lower surface of said platform base by an attachment means, said platform flange assembly having:

a) a substantially-centered, upper bearing cavity and a lower bearing cavity, wherein each said bearing cavity having therethrough a cavity shaft bore that is in alignment with the shaft bore located on said platform base, b) an upper bearing that is inserted into the upper bearing cavity and attached thereto by a bearing attachment means, and c) a lower bearing that is inserted into the lower bearing cavity and attached thereto by a bearing attachment means.

6. The mechanism as specified in claim 1 wherein the angled section of said shaft ranges from 2 to 10 degrees.

7. The mechanism as specified in claim 5 wherein said means for maintaining said shaft in a vertical position comprises at least one collar that is located between said housing flange assembly and said platform flange assembly.

8. The mechanism as specified in claim 1 further comprising a resilient section that is attached to the upper surface of said platform base, wherein said resilient section is dimensioned to comfortably allow a person who is located on the upper surface of the resilient section to produce the required torque to operate said mechanism.

9. A kinematic rotating-tilting mechanism comprising:

a) a housing having:
   (1) enclosed sides,
   (2) a lower end,
   (3) an upper end having an integrally attached cover having a substantially centered housing shaft bore and a plurality of flange attachment bores, b) a housing flange assembly having:
   (1) an upper surface,
   (2) a lower surface,
   (3) a plurality of housing attachment bores that are in alignment with the plurality of flange attachment bores which are located on the cover of said housing, wherein the lower surface of said housing flange assembly is attached to the upper surface of said cover by a like plurality of bolt and nut combinations,
   (4) a substantially centered, upper bearing cavity and a lower bearing cavity, wherein each said bearing cavity having therethrough a cavity shaft bore that is in alignment with the housing shaft bore located on said housing,
   (5) an upper bearing that is inserted into the upper bearing cavity and attached thereto by a bearing attachment means, and
   (6) a lower bearing that is inserted into the lower bearing cavity and attached thereto by a bearing attachment means, c) a platform flange assembly having:
   (1) an upper surface,
   (2) a lower surface,
   (3) a plurality of platform attachment bores,
   (4) a substantially-centered, upper bearing cavity and a lower bearing cavity, wherein each said cavity having therethrough a cavity shaft bore,
   (5) an upper bearing that is inserted into the upper bearing cavity and attached thereto by a bearing attachment means, and
   (6) a lower bearing that is inserted into the lower bearing cavity and attached thereto by a bearing attachment means, d) a platform base having:
   (1) a front end,
   (2) a rear end,
   (3) an upper surface,
   (4) a lower surface,
   (5) a shaft bore that is located at or near the center of gravity of said platform base,
   (6) a plurality of flange attachment bores that are in alignment with the plurality of platform attachment bores located on said platform flange assembly, wherein the lower surface of said platform base is attached to the upper surface of said platform flange assembly by a like plurality of bolt and nut combinations,
   (7) a plurality of resilient section attachment bores, and e) a resilient section that extents upward from a base section having a plurality of threaded inserts that are in alignment with the plurality of resilient section attachment bores located on said platform base, wherein when a threaded bolt is inserted into the threaded inserts, said resilient section is attached to said platform base, and f) a shaft having a lower vertical section having a lower terminus and an integral, upper angled section having an upper terminus and an angle θ that can range between 2 to 10 degrees as measured from the lower vertical section, wherein the lower vertical section is inserted sequentially through the upper bearing and the lower bearing of said housing flange assembly, with the lower terminus located within the confines of said housing, and wherein the upper angled section is inserted sequentially into the lower bearing and the upper bearing of said platform flange assembly, with the upper terminus projecting outward from the upper bearing and into the shaft bore located on said platform base, wherein into said shaft is inserted and attached a shaft collar that is located adjacent the lower surface of said platform flange assembly, wherein when a right or left lateral force is applied to said platform base by a person who is located on said resilient section, torque is produced that causes the lower vertical section of said shaft to laterally rotate through a 360-degree rotation or any increment thereof, thereby causing said platform base to rotate in either a right or a left horizontal circular plane, simultaneously the upper angled section of said shaft causes said platform base to rotate and alternate its angular position, that is, the front end of said platform base moves from a lower position to an upward position, while the rear end of said platform base moves from an upward position to a lower position, thus said platform base simultaneously causes said resilient section to rotate and tilt.

10. The mechanism as specified in claim 9 further comprising a set of four curved housing legs, wherein each said leg has an upper end and a lower end, wherein the upper ends are equidistantly spaced and attached adjacent to the upper end of said housing by a leg attachment means and the lower ends of said legs are on the same plane as the lower end of said housing.

11. The mechanism as specified in claim 10 wherein said leg attachment means comprises a welding process.

12. The mechanism as specified in claim 10 wherein the lower end of said housing is comprised of an open lower end.

13. The mechanism as specified in claim 12 further comprising a resilient cap that is frictionally attached around the open lower end of said housing and to the lower end of each curved housing leg.

14. The mechanism as specified in claim 9 further comprising a set of four legs, wherein each said leg has a vertical section and a horizontal section, wherein the vertical sections are each equidistantly spaced and attached to the respective side of said housing by a leg attachment means, wherein the horizontal sections are on the same plane as the lower end of said housing, and wherein a resilient section is attached to the lower surface of the vertical section.

15. The mechanism as specified in claim 9 wherein said upper and lower bearings are comprised of ball bearings.

16. The mechanism as specified in claim 9 wherein said upper and lower bearings are comprised of bronze sleeve bearings.

17. The mechanism as specified in claim 9 wherein said upper and lower bearing attachment means comprises a friction fit.

18. The mechanism as specified in claim 17 wherein said friction fit further comprises an adhesive that is applied between said bearings and the respective cavity interfacing surface.

19. The mechanism as specified in claim 9 further comprising a shaft collar that is inserted and attached to said shaft adjacent the upper surface of said housing flange assembly.

20. The mechanism as specified in claim 19 wherein said shaft collar is comprised of a two-piece clamp-on collar.

* * * * *